US007090503B2

(12) United States Patent
Dittmann

(10) Patent No.: US 7,090,503 B2
(45) Date of Patent: Aug. 15, 2006

(54) INTERPOSER WITH COMPLIANT PINS

(75) Inventor: Larry E. Dittmann, Middletown, PA (US)

(73) Assignee: Neoconix, Inc., Sunnyvale, CA (US)

( * ) Notice: Subject to any disclaimer, the term of this patent is extended or adjusted under 35 U.S.C. 154(b) by 0 days.

(21) Appl. No.: 10/894,608

(22) Filed: Jul. 20, 2004

(65) Prior Publication Data

US 2005/0208787 A1 Sep. 22, 2005

Related U.S. Application Data

(60) Provisional application No. 60/554,719, filed on Mar. 19, 2004.

(51) Int. Cl.
*H01R 12/00* (2006.01)

(52) U.S. Cl. ..... 439/66

(58) Field of Classification Search ..... 439/78, 439/83, 66

See application file for complete search history.

(56) References Cited

U.S. PATENT DOCUMENTS

| | | | | |
|---|---|---|---|---|
| 3,543,587 | A | 12/1970 | Kawada | |
| 3,634,807 | A | 1/1972 | Grobe et al. | |
| 3,670,409 | A | 6/1972 | Reimer | |
| 4,175,810 | A | 11/1979 | Holt et al. | |
| 4,548,451 | A | 10/1985 | Benarr et al. | |
| 4,657,336 | A | 4/1987 | Johnson et al. | |
| 4,893,172 | A | 1/1990 | Matsumoto et al. | |
| 4,998,885 | A | 3/1991 | Beaman | |
| 5,135,403 | A | 8/1992 | Rinaldi | |
| 5,148,266 | A | 9/1992 | Khandros et al. | |
| 5,152,695 | A | 10/1992 | Grabbe et al. | |
| 5,173,055 | A | 12/1992 | Grabbe | |
| 5,199,879 | A | 4/1993 | Kohn et al. | |
| 5,228,861 | A | 7/1993 | Grabbe | |
| 5,257,950 | A | 11/1993 | Lenker et al. | |
| 5,292,558 | A | 3/1994 | Heller et al. | |
| 5,299,939 | A | 4/1994 | Walker et al. | |
| 5,358,411 | A | 10/1994 | Mroczkowski et al. | |
| 5,366,380 | A * | 11/1994 | Reymond | 439/66 |
| 5,468,655 | A | 11/1995 | Greer | |

(Continued)

FOREIGN PATENT DOCUMENTS

| | | |
|---|---|---|
| EP | 0692823 | 1/1996 |

(Continued)

OTHER PUBLICATIONS

An article entitled "Patented Socketing System for the BGA/CSP Technology" by E-tec Interconnect Ltd., pp. 1-4.

(Continued)

*Primary Examiner*—Khiem Nguyen
(74) *Attorney, Agent, or Firm*—Michael Bednarek; Pillsbury Winthrop Shaw Pittman LLP

(57) ABSTRACT

An electrical interposer including first and second surfaces is provided. A plurality of compliant pins are connected to the first surface of the substrate, each of the compliant pins having a drawn body with at least one side wall extending along a longitudinal axis thereof substantially perpendicular to the substrate. A plurality of contact elements are connected to the substrate for making electrical contact with a device facing the second surface of the substrate. Electrical paths connect the compliant pins to the contact elements.

27 Claims, 11 Drawing Sheets

U.S. PATENT DOCUMENTS 5,483,741 A 1/1996 Akram et al.
5,509,814 A 4/1996 Mosquera
5,530,288 A 6/1996 Stone
5,532,612 A 7/1996 Liang
5,590,460 A 1/1997 DiStefano et al.
5,593,903 A 1/1997 Beckenbaugh et al.
5,629,837 A 5/1997 Barabi et al.
5,632,631 A 5/1997 Fjelstad et al.
5,751,556 A 5/1998 Butler et al.
5,772,451 A 6/1998 Dozier, II et al.
5,791,911 A 8/1998 Fasano et al.
5,802,699 A 9/1998 Fjelstad et al.
5,812,378 A 9/1998 Fjelstad et al.
5,842,273 A 12/1998 Schar
5,860,585 A 1/1999 Rutledge et al.
5,896,038 A 4/1999 Budnaitis et al.
5,934,914 A 8/1999 Fjelstad et al.
5,967,797 A 10/1999 Maldonado
5,980,335 A 11/1999 Barbieri et al.
5,989,994 A 11/1999 Khoury et al.
6,019,611 A 2/2000 McHugh et al.
6,029,344 A 2/2000 Khandros et al.
6,031,282 A 2/2000 Jones et al.
6,032,356 A 3/2000 Eldridge et al.
6,042,387 A 3/2000 Jonaidi
6,063,640 A 5/2000 Mizukoshi et al.
6,083,837 A 7/2000 Millet
6,133,534 A 10/2000 Fukutomi et al.
6,146,151 A 11/2000 Li
6,156,484 A 12/2000 Bassous et al.
6,184,699 B1 2/2001 Smith et al.
6,196,852 B1 * 3/2001 Neumann et al. ..... 439/66
6,200,143 B1 3/2001 Haba et al.
6,204,065 B1 3/2001 Ochiai
6,205,660 B1 3/2001 Fjelstad et al.
6,208,157 B1 3/2001 Akram et al.
6,221,750 B1 4/2001 Fjelstad
6,224,392 B1 5/2001 Fasano et al.
6,250,933 B1 6/2001 Khoury et al.
6,255,727 B1 7/2001 Khoury
6,263,566 B1 7/2001 Hembree et al.
6,264,477 B1 7/2001 Smith et al.
6,293,806 B1 * 9/2001 Yu ..... 439/66
6,293,808 B1 9/2001 Ochiai
6,297,164 B1 10/2001 Khoury et al.
6,298,552 B1 10/2001 Li
6,306,752 B1 10/2001 DiStefano et al.
6,335,210 B1 1/2002 Farooq et al.
6,336,269 B1 1/2002 Eldridge et al.
6,337,575 B1 1/2002 Akram
6,361,328 B1 * 3/2002 Gosselin ..... 438/78
6,373,267 B1 4/2002 Hiroi
6,374,487 B1 4/2002 Haba et al.
6,392,524 B1 5/2002 Biegelsen et al.
6,392,534 B1 5/2002 Flick
6,397,460 B1 6/2002 Hembree
6,399,900 B1 6/2002 Khoury et al.
6,402,526 B1 * 6/2002 Schreiber et al. ..... 439/67
6,409,521 B1 6/2002 Rathburn
6,420,661 B1 7/2002 DiStefano et al.
6,420,789 B1 7/2002 Tay et al.
6,420,884 B1 7/2002 Khoury et al.
6,428,328 B1 8/2002 Haba et al.
6,436,802 B1 8/2002 Khoury
6,437,591 B1 8/2002 Faynworth et al.
6,442,039 B1 8/2002 Schreiber
6,452,407 B1 9/2002 Khoury et al.
6,461,892 B1 10/2002 Beroz
6,465,748 B1 10/2002 Yamanashi et al.
6,472,890 B1 10/2002 Khoury et al.
6,474,997 B1 11/2002 Ochiai
6,492,251 B1 12/2002 Haba et al.
6,517,362 B1 2/2003 Hirai et al.
6,520,778 B1 2/2003 Eldridge et al.
6,524,115 B1 2/2003 Gates et al.
6,551,112 B1 4/2003 Li et al.
6,576,485 B1 6/2003 Zhou et al.
6,604,950 B1 8/2003 Maldonado et al.
6,612,861 B1 9/2003 Khoury et al.
6,616,966 B1 9/2003 Mathieu et al.
6,622,380 B1 9/2003 Grigg
6,627,092 B1 9/2003 Clements et al.
6,640,432 B1 11/2003 Mathieu et al.
6,661,247 B1 12/2003 Maruyama et al.
6,664,131 B1 12/2003 Jackson
6,671,947 B1 1/2004 Bohr
6,677,245 B1 1/2004 Zhou et al.
6,692,263 B1 2/2004 Villain et al.
6,700,072 B1 3/2004 Distefano et al.
6,701,612 B1 3/2004 Khandros et al.
6,719,569 B1 4/2004 Ochiai
6,730,134 B1 5/2004 Neidich
6,736,665 B1 5/2004 Zhou et al.
6,750,136 B1 6/2004 Zhou et al.
6,791,171 B1 9/2004 Mok et al.
6,814,584 B1 11/2004 Zaderej
6,814,587 B1 11/2004 Ma
6,815,961 B1 11/2004 Mok et al.
6,843,659 B1 1/2005 Liao et al.
6,847,101 B1 1/2005 Fjelstad et al.
6,848,173 B1 2/2005 Fjelstad et al.
6,853,210 B1 2/2005 Farnworth et al.
6,857,880 B1 2/2005 Ohtsuki et al.
6,881,070 B1 4/2005 Chiang
6,916,181 B1 * 7/2005 Brown et al. ..... 439/66
2001/0001080 A1 5/2001 Eldridge et al.
2002/0011859 A1 1/2002 Smith et al.
2002/0055282 A1 5/2002 Eldridge et al.
2002/0058356 A1 5/2002 Oya
2002/0079120 A1 6/2002 Eskildsen et al.
2002/0117330 A1 8/2002 Eldridge et al.
2002/0129894 A1 9/2002 Liu et al.
2002/0133941 A1 9/2002 Akram et al.
2002/0146919 A1 10/2002 Cohn
2002/0178331 A1 11/2002 Beardsley et al.
2003/0000739 A1 1/2003 Frutschy et al.
2003/0003779 A1 1/2003 Rathburn
2003/0022503 A1 1/2003 Clements et al.
2003/0035277 A1 2/2003 Saputro et al.
2003/0049951 A1 3/2003 Eldridge et al.
2003/0089936 A1 5/2003 McCormack et al.
2003/0096512 A1 5/2003 Cornell
2003/0099097 A1 5/2003 Mok et al.
2003/0129866 A1 7/2003 Romano et al.
2003/0147197 A1 8/2003 Uriu et al.
2003/0194832 A1 10/2003 Lopata et al.
2004/0118603 A1 6/2004 Chambers
2004/0127073 A1 7/2004 Ochiai
2005/0099193 A1 5/2005 Burgess

FOREIGN PATENT DOCUMENTS

EP 1 005 086 5/2000
EP 1208241 1/2003
JP 200011443 4/2000
JP 2001203435 7/2001
WO WO 9602068 1/1996
WO WO 9744859 11/1997
WO WO 0213253 2/2002

OTHER PUBLICATIONS

Gary B. Kromann et al., "Motorola's PowerPC 603 and PowerPC 604 RISC Microprocessor: the C4/Cermanic-ball-grid Array Interconnect Technology," Motorola Advanced Packaging Technology, Motorola, Inc., 1996, pp. 1-10.
Ravi Mahajan et al., "Emerging Directions for packaging Technologies," Intel Technology Journal, V. 6, Issue 02, May 16, 2002, pp. 62-75.
International Search Report and Written Opinion dated Oct. 18, 2005.

* cited by examiner

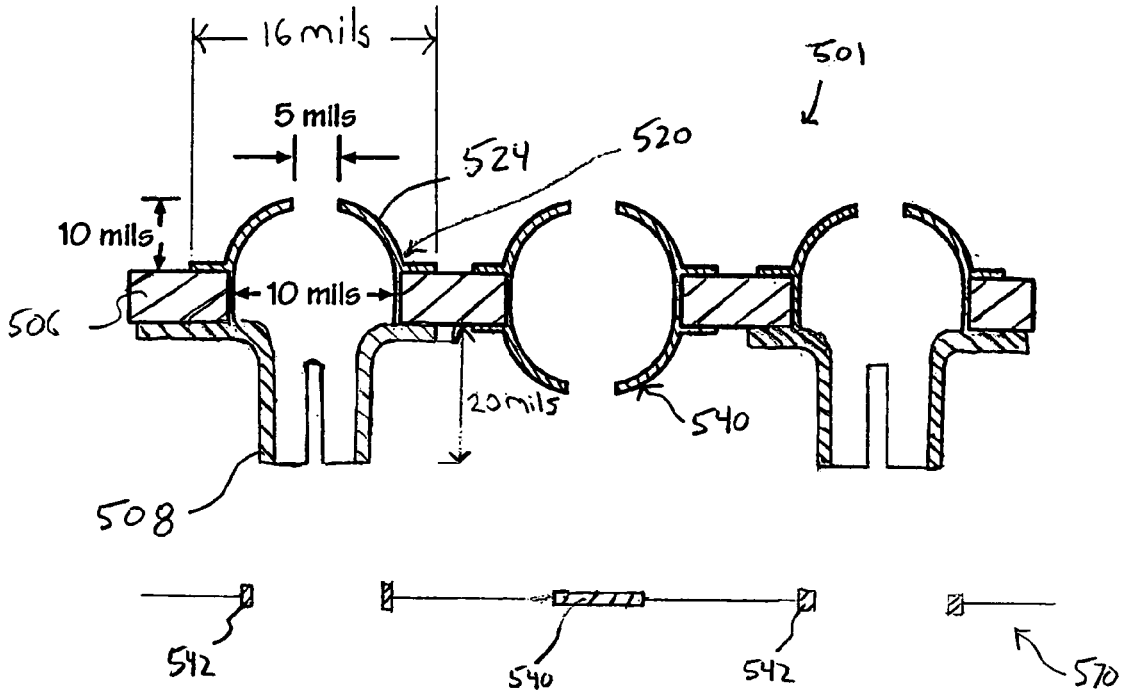
FIGURE 11
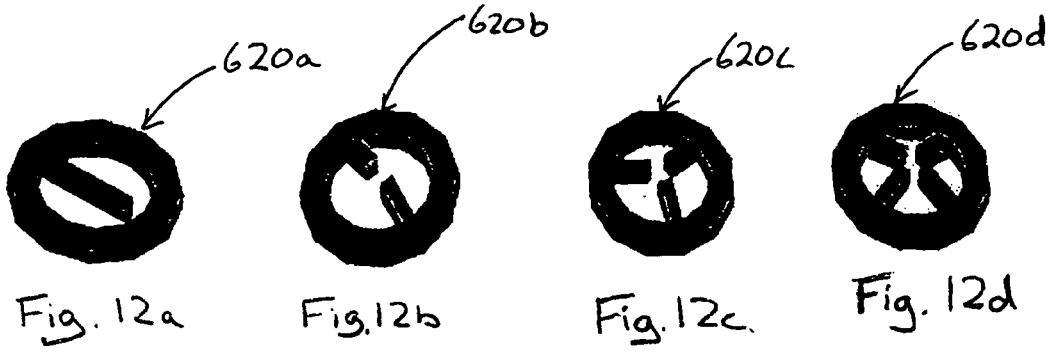

INTERPOSER WITH COMPLIANT PINS

This application claims priority to Provisional Patent Application No. 60/554,719 filed Mar. 19, 2004 which is herein incorporated by reference in its entirety.

FIELD OF INVENTION

The present invention is related to electrical connectors. More particularly, the present invention is directed to an interposer including a plurality of compliant pins and contact elements having elastic portions. The present invention also includes a method for making the interposer.

BACKGROUND

Electronic components such as resistors, transistors, diodes, inductors, capacitors, packaged integrated circuits, and unpackaged dies must interface with other electronic components in an endless variety of systems. It would be desirable to provide a device which allows for electronic components to connect in a mechanically convenient manner, yet provides a high level of electrical performance and scalability.

BRIEF DESCRIPTION OF THE DRAWING(S)

Figure 9A:
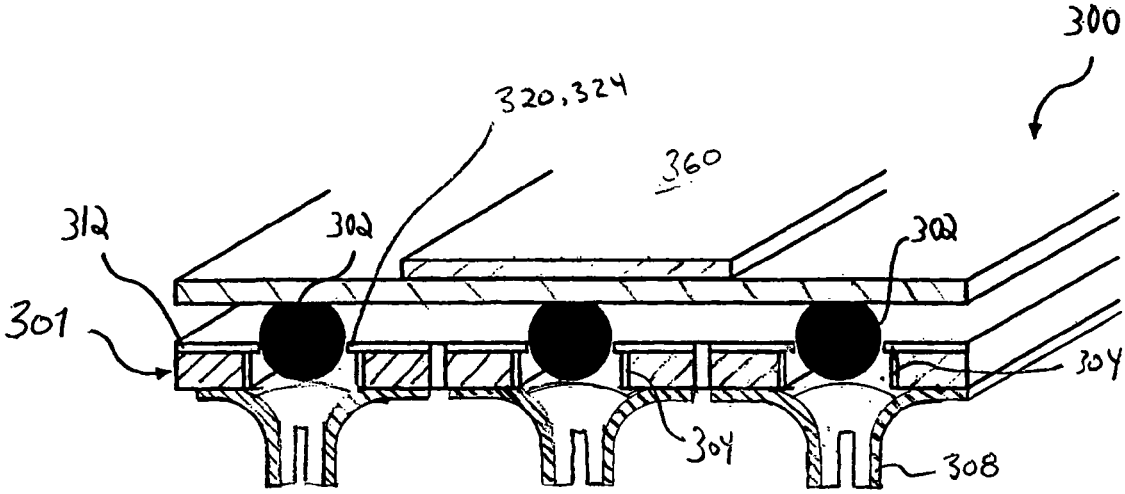
Figure 9B:
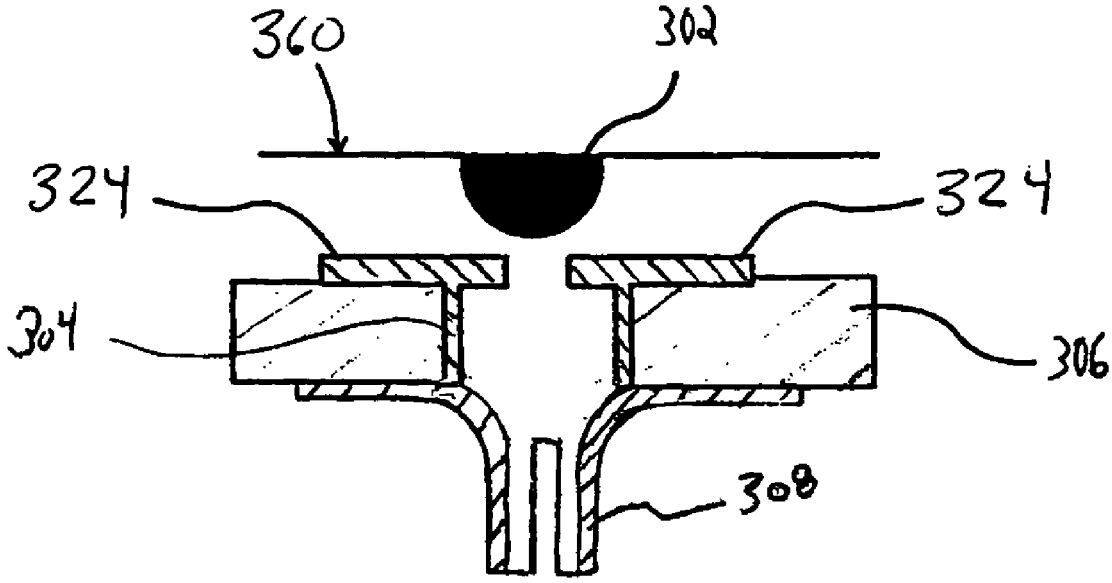

FIG. 9*a* is an enlarged, perspective sectional view of a beam ball grid array (BBGA) system of the present invention and its attachment to a device, package, or module;

FIG. 9*b* is an elevational sectional view of the contact system of FIG. 9*a;*

Figure 9C:
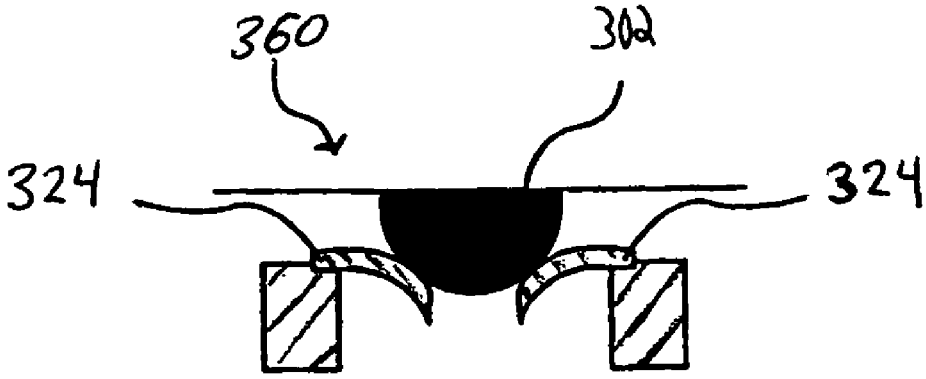

FIG. 9*c* is a generic sectional view showing contact arm deformation in accordance with the embodiment shown in FIGS. 9*a* and 9*b;*

Figure 9E:
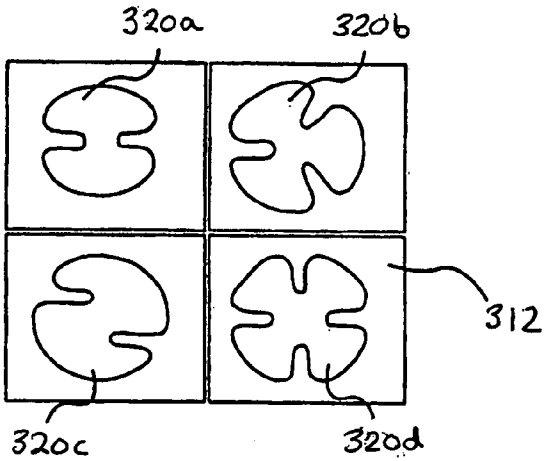
Figure 9D:
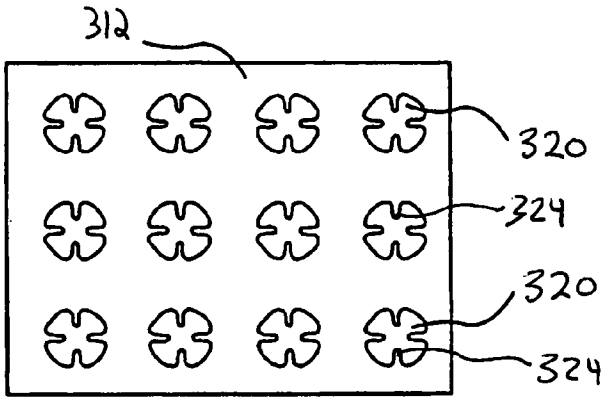

FIG. 9*d* is a plan view of a contact element array as shown in FIG. 9*a;*

Figure 10:
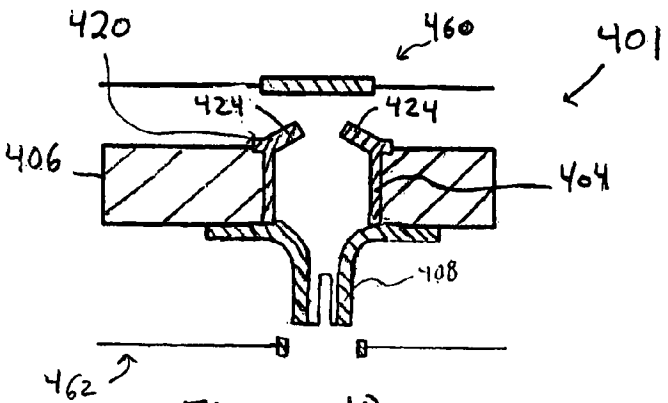
Figure 13:
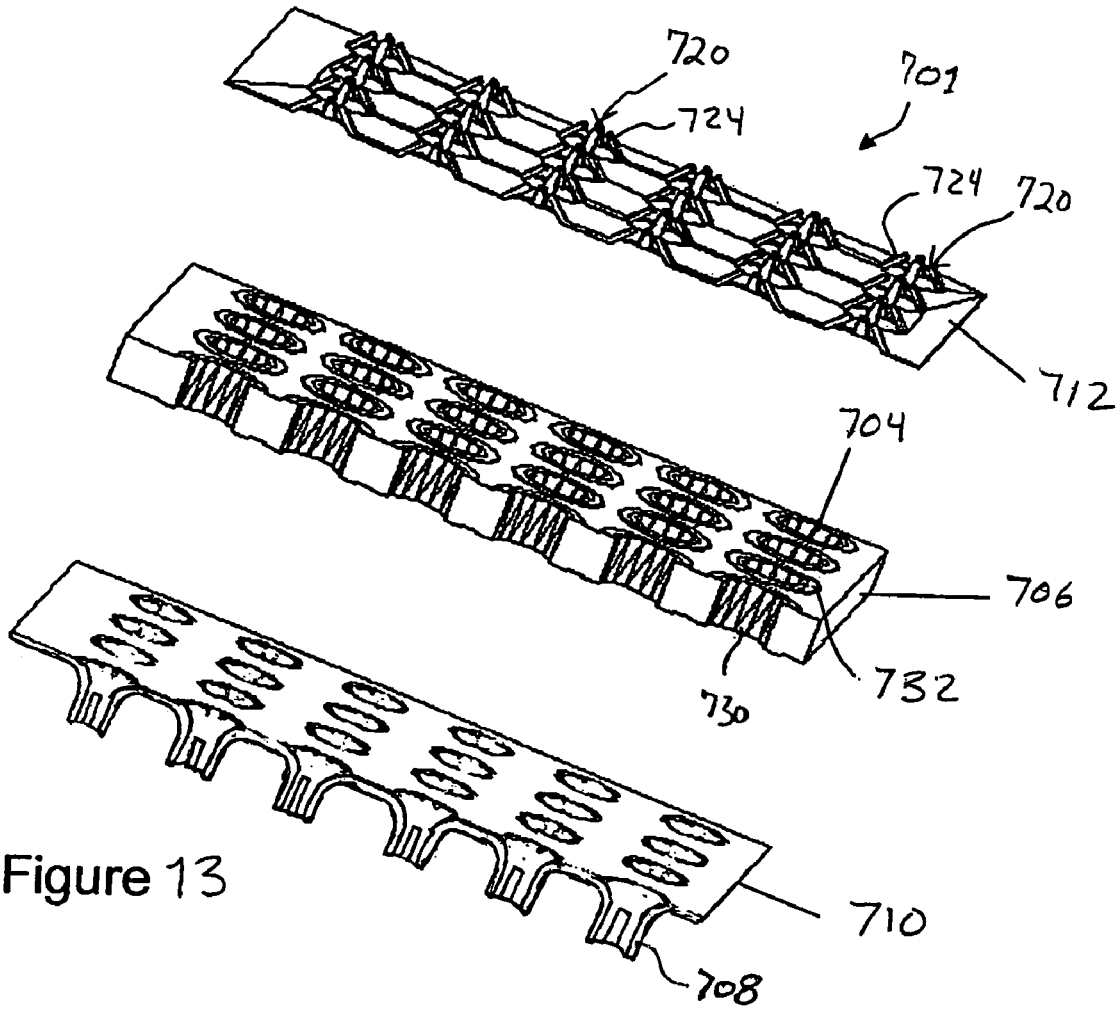
Figure 14:
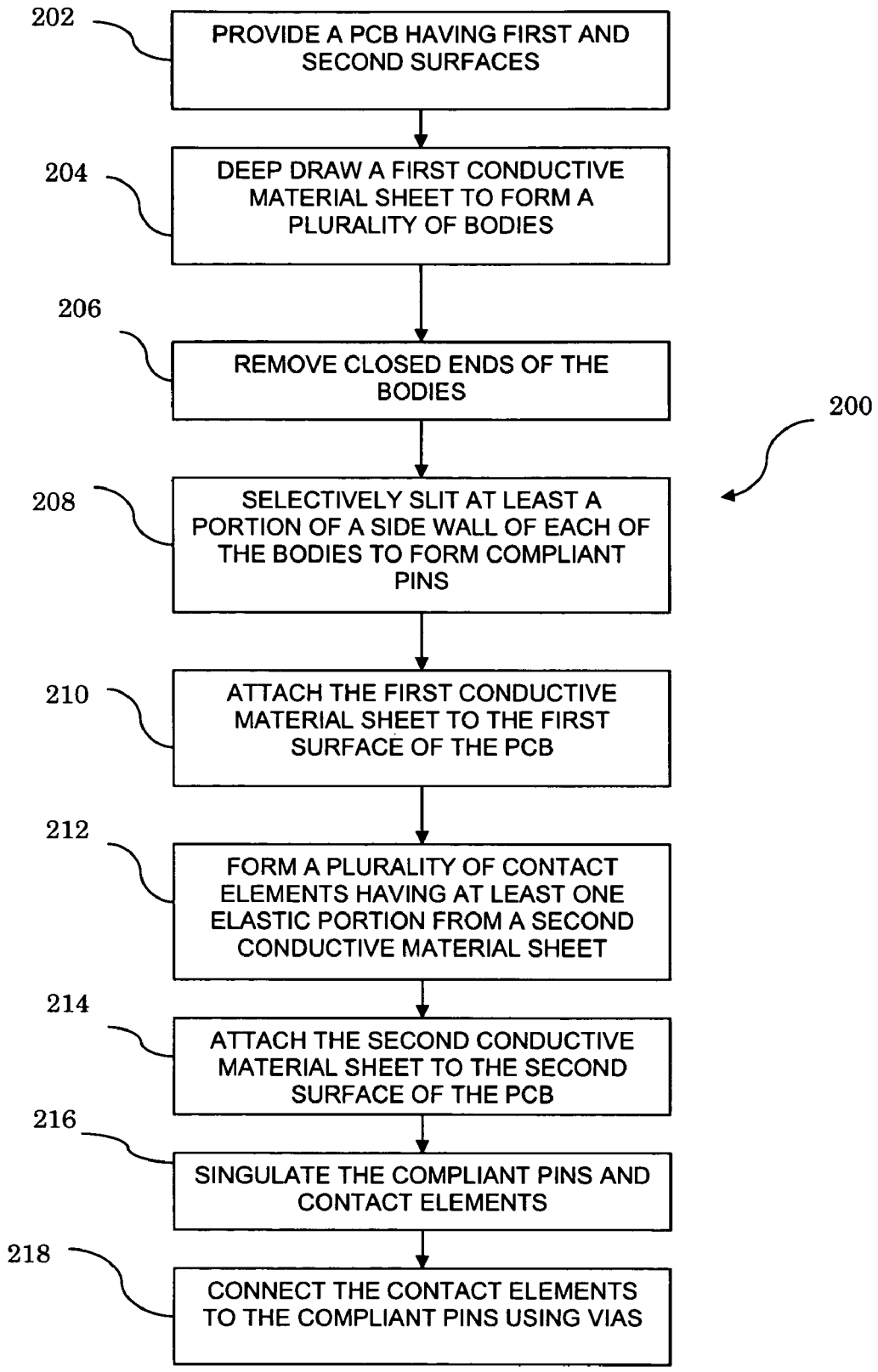

FIG. 9*e* is a plan view of alternative contact element designs;

FIG. 10 is a cross-sectional view of a land grid array (LGA) system and its attachment to first and second devices according to a preferred embodiment of the present invention;

FIG. 11 is an elevational sectional view of a LGA contact system according to another preferred embodiment of the present invention;

FIGS. 12*a–d* are perspective view of different contact element designs;

FIG. 13 is an exploded perspective views of a connector according to another preferred embodiment of the present invention;

FIG. 14 is a flowchart depicting a process for creating a connector according to a preferred embodiment of the present invention.

DETAILED DESCRIPTION OF THE PREFERRED EMBODIMENT(S)

The present invention will be described with reference to the drawing figures wherein like numerals represent like elements throughout. The terms "down", "up", "bottom", "side" or "top" as used hereinafter are used only for convenience to differentiate certain aspects of the preferred embodiments in the orientation shown in the figures. It should be understood that these terms are not meant to limit the functional aspects of the elements to which the terms apply.

Disclosure which may be useful for the practice and/or the understanding of the below described invention may be found in U.S. patent application Ser. No. 10/412,729, filed Apr. 11, 2003, that is subject to assignment to the same assignee as the present application, which is incorporated by reference as if fully set forth.

Figure 1:
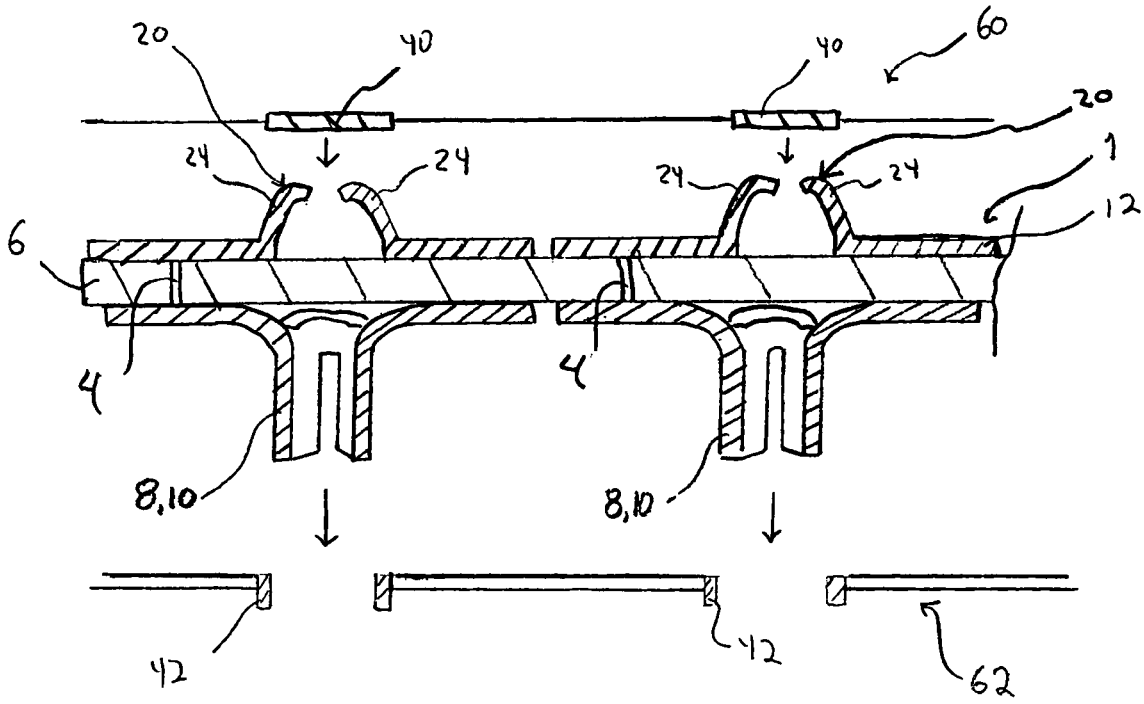
FIG. 1 is a cross-sectional elevation view showing an installation detail of an interposer according to a preferred embodiment of the invention.

Referring to FIGS. 1 and 14, the present invention provides an interposer 1 and a method for making the interposer 1. The interposer 1 includes a printed circuit board (PCB) 6 and a plurality of compliant pins 8 adhered to a first surface thereof. A layer 12, which includes a plurality of contact elements 20 including elastic portions or contact arms 24, is adhered to a second surface of the PCB 6. Vias 4 provide an electrical path between the compliant pins 8 and the layer 12. As such, the interposer 1 is suitable for connecting first and second devices 60, 62 together.

Figure 2:
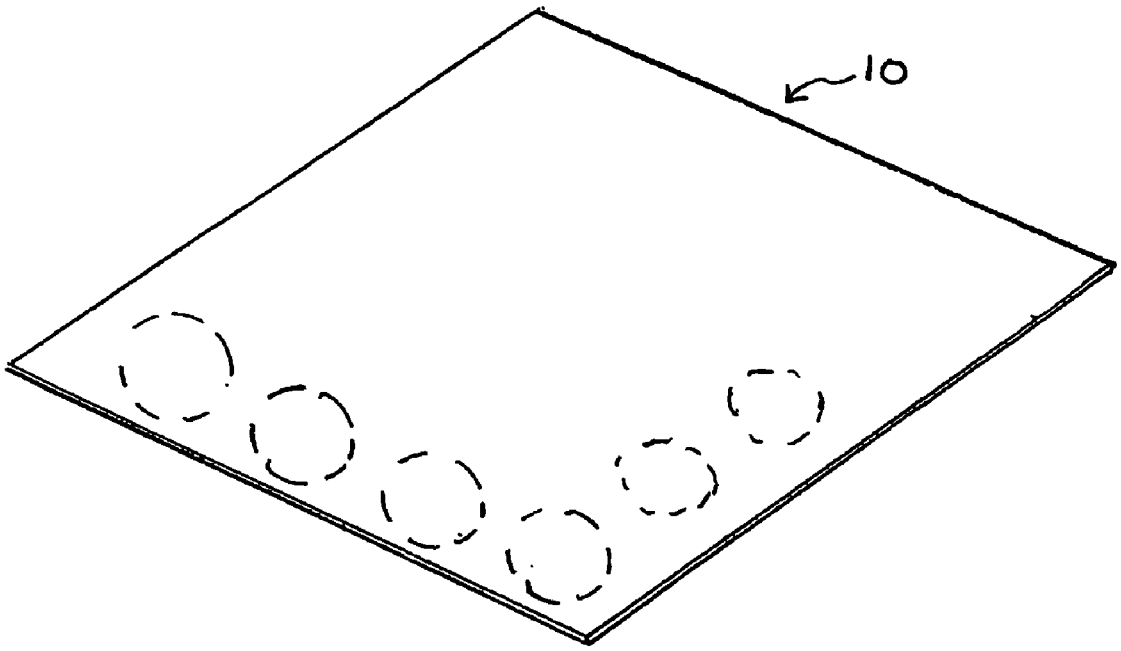
FIG. 2 is a perspective view of a sheet of conductive and resilient material for forming at least one, and more preferably an array of compliant pins according to a preferred embodiment of the invention.

The compliant pins 8 are preferably fabricated from a single sheet of conductive and resilient material such as copper (Cu) or beryllium copper (BeCu). Alternatively, brass, phosphorous bronze or other suitable alloys may also be used. Referring to FIG. 2, a sheet 10 of conductive and resilient material is shown. Although the sheet 10 is shown as being configured in a generally square shape having a certain thickness, those of skill in the art should realize that this is for convenience of explanation and the shape and/or thickness of the sheet 10 will vary depending upon the particular application and the desired physical characteristics of the compliant pin. Such physical characteristics, for example, may include the impedance of the compliant pin, the desired normal force to be applied by the compliant pin and the working range of the compliant pin. The length and width of the compliant pin, as well as the distance between adjacent ones of the pins (i.e. the pitch) are also factors used in the selection of material composition and thickness.

Figure 3:
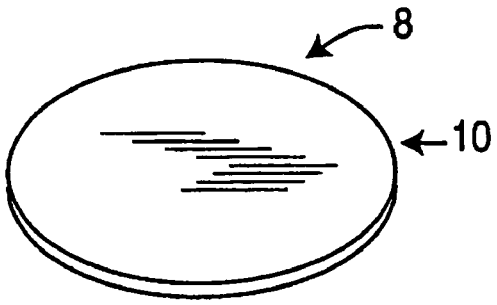
FIG. 3 is a perspective view of a portion of the conductive and resilient material sheet representative of each of the areas depicted in dashed lines in FIG. 2.

Referring to FIG. 3, a partial view of the sheet 10, representative of each of circular areas depicted in dashed lines in FIG. 2, is shown. This portion of the sheet 10 corresponds to the areas in which each of the compliant pins 8 are formed.

Figure 4:
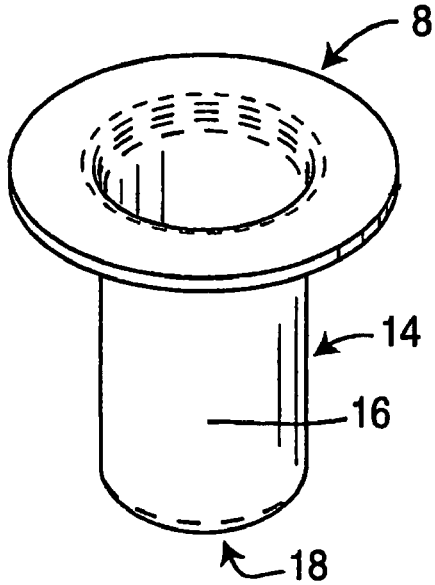
FIG. 4 is a perspective view of the sheet portion of FIG. 3 which has been deep drawn to form a body.

The sheet 10 is drawn to form one or more cavities using a deep drawing process as shown in FIG. 4. Deep drawing is a well known process to those of skill in the metallurgical arts and, therefore, a description of the process will not be set forth in detail hereinafter. Generally, however, deep drawing selectively stretches a sheet of material to form a desired three-dimensional shape. The cylindrical shape as shown in FIG. 4 and the subsequent Figures is for example only and the shape may be any shape desired for the particular application. For example, the body 14 may be substantially rectilinear in shape, or may be drawn much deeper or much more shallow than shown.

The body 14 generally comprises one or more side walls 16 and a bottom 18. The body 14 shown in the figures is substantially cylindrical and slightly tapered toward the bottom to allow easier insertion, and comprises a single continuous wall 16. However, the body 14 could also be a cubic or other three-dimensional shape, so that there may be a plurality of side walls 16. Likewise, although a bottom 18 is shown, a deep drawing process may be used such that there is no bottom 18 to the body 14.

Figure 5:
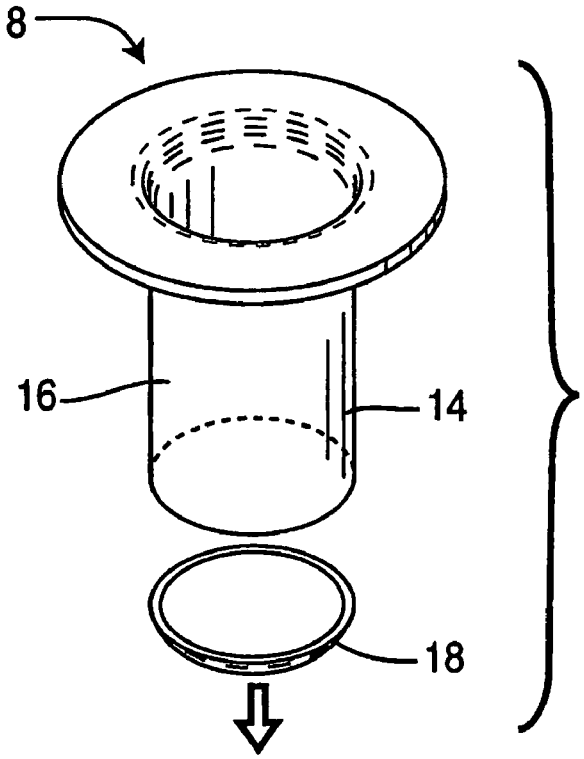
FIG. 5 is a perspective view of the body with an end of the body being removed.

If the body 14 includes a bottom 18, the bottom 18 may optionally be removed as shown in FIG. 5. This step is preferably used when it is desired to have a compliant pin with an extended mechanical operating range. As such, removing the bottom 18 from the body 14 would have certain operational advantages, although this step is optional and is not required for the compliant pin 8 to operate properly.

Figure 6:
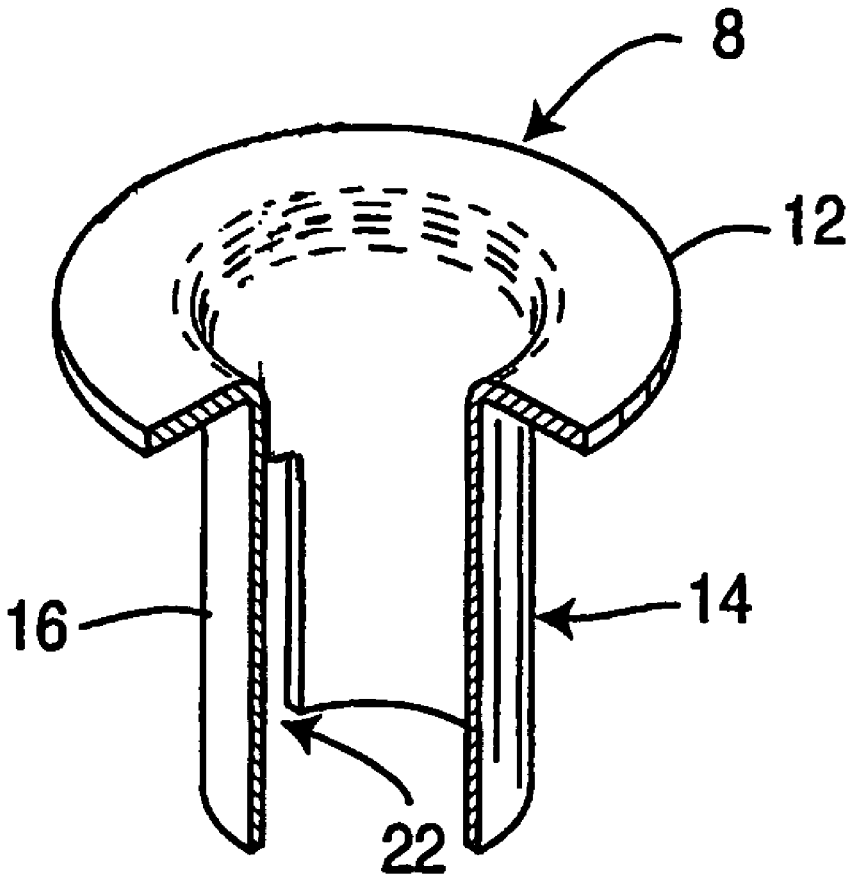
FIG. 6 is a perspective view, partially broken away, of the completed compliant pin.
Figure 7:
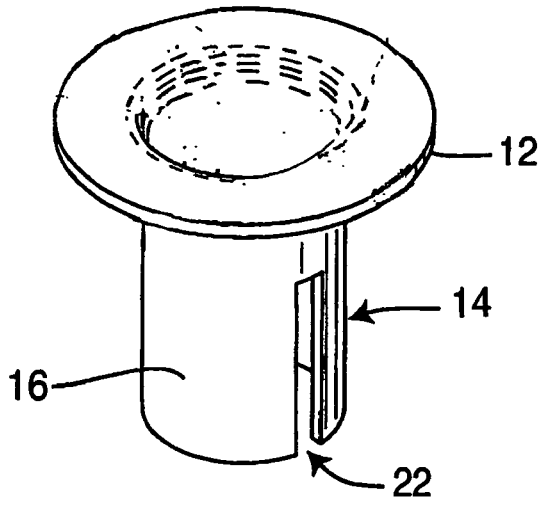
FIG. 7 is a perspective view of the completed compliant pin.
Figure 8:
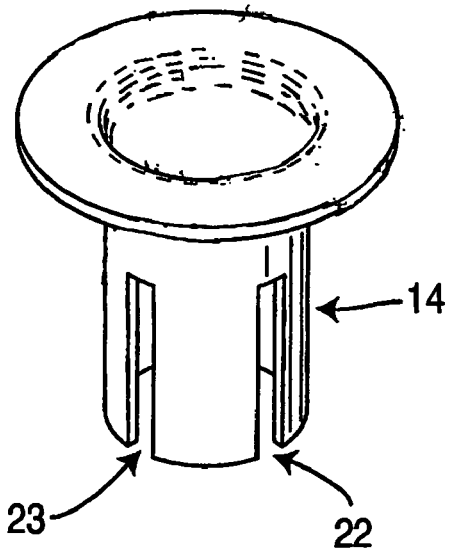
FIG. 8 is a perspective view of an alternative embodiment of the compliant pin having additional side wall slits.

Referring to FIGS. 6 and 7, at least one slit is made in the wall 16 to form an opening 22. Although preferably at least one opening 22 is formed in the wall 16, any suitable number of openings can be formed, depending on the required insertion force and normal spring force desired. Referring to FIG. 8, for example, an additional opening 23 is added to provide added compliancy in the pin 8. Alternatively, the pins 8 may be provided without openings.

Referring again to FIG. 1, the completed sheet 10 with compliant pins 8 is attached to the PCB 6 to form the interposer 1, preferably using a suitable bonding adhesive such as polyimide, epoxy, silver-filled glass adhesive or other adhesive including pressure sensitive and heat cured adhesives. Depending on the particular application, one or more of the compliant pins 8 are then singulated, preferably using known etching techniques. Alternatively, mechanical or electrical techniques of singulating the compliant pins 8 may be used.

The contact elements 20, including elastic portions, may be formed from a conductive material sheet by a stamping, etching or other suitable process. Alternatively, the contact elements 20 and layer 12 can be deposited by a CVD process, electro plating, sputtering, PVD, or other conventional metal film deposition techniques. After the contact elements 20 and the compliant pins 8 have been provided on the PCB 6, it is preferable to electroplate the interposer 1 to ensure electrical continuity between the pins 8, contact elements 20, and vias 4.

In the preferred embodiment shown in FIG. 1, the arms 24 are suitable for connection with land contacts 40 of the first device 60. The first device 60 may represent a packaged electronic component having land grid array (LGA) contacts, or alternatively, may represent any component having one or more substantially flat contact areas. The arms 24 are capable of significant elastic bending to allow good contact between mating surfaces even if such surfaces are not entirely planar. Further, by providing alternative configurations of the arms, a variety of device types may be interfaced.

The interposer 1 may also be selectively connected to the second device 62 using the compliant pins 8. The second device 62 as shown may represent a second PCB, a cable connector or other components. Preferably, the compliant pins 8 are connectable with plated through holes 42 of the second device 62. The compliant pins 8 provide a spring force radially outwardly against the perimeter of the holes 42 to removably retain the pins 8 in the holes. The removable connection may be made permanent through use of solder, adhesive bonding or other known bonding methods. If openings 22, 23 are not provided in the pins 8, it is preferable that the interposer be assembled using solder to attach the pins to the holes 42. In such an instance, the sheet 10 is preferably Copper (Cu) or a suitable Copper Alloy.

Alternatively, the interposer 1 may be connected with cables or other electronic devices using the compliant pins 8 which are scalable and may be sized to accommodate a variety of electronic devices of different sizes and applications.

Referring to FIGS. 9*a* through 9*c*, cross-sectional views of a beam ball grid array (BBGA) system constructed in accordance with an alternate preferred embodiment of the present invention is shown. Solder balls 302 provide a method of establishing an electrical contact between a device, packages, or module 360, and a carrier/interposer 301. The solder balls 302 are shown positioned within through plated vias 304 that have been fabricated in the interposer 301 by printed circuit techniques. The solder balls 302 are given elasticity by virtue of their suspension upon contact elements 320, which include flexible contact arms 324 formed as part of a layer 312. The contact arms 320 cradle the solder ball 302 and provide a spring-like support, as shown in FIG. 9*c*, which is a generic representation of the embodiments of FIGS. 9*a* and 9*b*.

An array of the contact elements 320 fabricated in the layer 312, is shown in FIG. 9*d*. Different design patterns for the contact elements 320 are respectively illustrated by elements 320*a*, 320*b*, 320*c*, and 320*d* in FIG. 9*e*.

FIG. 10 is a cross-sectional view of a Beam Land Grid Array (BLGA) interposer 401 according to another preferred embodiment of the present invention. The BLGA interposer 401 includes a carrier layer 406, which is preferably a PCB. A contact element 420 includes an array of elastic arms 424 that extend out of the plane of the carrier layer 406. A through plated via 404 connects the arms 424 to a compliant pin 408 of the type described above. The angle, thickness, and number of the arms 424 can be readily changed to provide specific design features such as contact force, current carrying capacity, and contact resistance. The interposer 401 is suitable for connection to a first device 460 and second device 462. The elements 420 can have shapes similar to the elements 320*a–d* in FIG. 9*e*.

FIG. 11 shows a cross-sectional view of an interposer 501 in accordance with another preferred embodiment of the invention, including exemplary dimensions for the size of the portions of elements 520. The spacing between the distal ends of arms 524 is 5 mils. The distance from the surface of a carrier layer 506 to a top portion of the arms 524 is 10 mils. The width of a through hole of the interposer 501 can be on the order of 10 mils. The width of the contact element 520 from the outer edge of one base portion to the outer edge of the other base portion is 16 mils. Contacts of this size can be formed in accordance with the method of the invention as described below, allowing connectors with a pitch well below 50 mils, and on the order of 20 mils or less. Pins 508 have a length of 20 mils, although shorter or longer lengths may be provided. It is noted that these dimensions are merely exemplary of what can be achieved with the present invention and one skilled in the art will understand from the present disclosure that a contact element with larger or smaller dimensions could be formed. Further, although the pins 508 and the elements 520 are shown sized similarly, one skilled in the art will recognize that the scale of the pins 508 and the elements 520 may be dissimilar to a small or great extent depending on the particular application.

The interposer 501 includes opposing contact elements 540 adjacent to alternating pins 508 on one of the sides of the interposer 501. This configuration allows the interposer 501 to interface with a device 570 having both plated through holes 542 and land contacts 540, or similar types of contacts, on a single surface.

According to another embodiment of the present invention, the following mechanical properties can be specifically engineered for contact elements or pins, to achieve certain desired operational characteristics. First, the contact force for each contact element and pin can be selected to ensure either a low resistance connection for some contact elements and/or pins, or a low overall contact force for the connector. Second, the elastic working range of each contact element and pin can be varied. Third, the vertical height of each contact element and pin can be varied. Fourth, the pitch or horizontal dimensions of the contact elements and pins can be varied.

Referring to FIGS. 12*a–d*, a plurality of contact element designs 620*a*,620*b*,620*c*,620*d* are shown for either a BBGA or a BLGA system. As aforementioned, these contact elements can be either stamped or etched into a spring-like structure, and can be heat treated before or after forming, if required, based on the material selected and the particular application.

FIG. 13 is an exploded perspective view showing the assembly of a connector 701 according to another preferred embodiment of the present invention. The connector includes a first sheet 710 including compliant pins 708 that is positioned on a first major surface of a dielectric substrate 706. An array of contact elements 720 having contact arms 724 are formed from a second sheet 712 that is positioned on a second major surface of a dielectric substrate 706. The contact elements 720 and the pins 708 are preferably aligned with respective holes 730 formed in the substrate 706. Metal traces or vias 704 are preferably provided in the holes 730 to connect the contact elements 720 from the second major surface to the pins 708 from the first major surface.

FIG. 13 shows the connector 701 during an intermediate step in the manufacturing process for forming the connector. Therefore, the array of contact elements 720 and the array of compliant pins 708 are shown as being joined together on the respective sheets of metal or metallic material 712, 710 from which they are formed. In the subsequent manufacturing steps, the unwanted portions of the metal sheets 710, 712 are removed, so that the contact elements 720 and pins 708 are isolated (i.e., singulated) as needed. For example, the metal sheets 710,712 can be masked and etched to singulate some or all of the contact elements 720 and/or compliant pins 708 from one another.

In one embodiment, the connector 701 of FIG. 13 is formed as follows. First, the dielectric substrate 706 including conductive paths between the top surface and the bottom surface is provided. The conductive paths are preferably in the form of the through plated traces or vias 704. Alternatively, other types of vias such as those shown in FIG. 1 may be used. The conductive metal sheet 712 or a multilayer metal sheet is patterned to form an array of contact elements 720 including a base portion and one or more elastic portions or arms 724. The contact elements 720, including the contact arms 724, can be formed by etching, stamping, and/or other means. The metal sheet 712 is attached to the second major surface of the dielectric substrate 706. The sheet 710 with compliant pins 708, that is formed as described above with reference to FIGS. 2–9, is attached to the first major surface of the dielectric substrate 706. The metal sheets 710, 712 can then be patterned to remove unwanted metal from the sheets so that the contact elements 720 and/or compliant pins 708 are isolated from each other (i.e., singulated) as needed. The metal sheets 710,712 can be patterned by etching, scribing, stamping, and/or other known methods.

In an alternate embodiment, the pins 708 and/or contact elements 720 can be singulated without attaching their respective sheets to the substrate. The singulated pins 708 or contact elements 720 may then be individually installed.

Furthermore, in the embodiment shown in FIG. 13, conductive traces 704 are formed in the through holes 730 and also on the surface of the dielectric substrate 706 in a ring-shaped pattern 732 encircling each plated through hole. While the conductive rings 732 can be provided to enhance the electrical connection among the contact elements 720, the pins 708 and the conductive traces formed in the dielectric layer 706, the conductive rings 732 are not required components of the connector 701. In another embodiment, the connector 701 can be formed by using a dielectric substrate including through holes that are not plated. After the metal sheets 710,712 are patterned to form singulated pins and contact elements, the entire connector 701 may be plated to form conductive traces in the through holes 730, connecting the contact elements 720 to the compliant pins 708 on the other side of the dielectric substrate.

Those skilled in the art will recognize that a connector according to the present invention could be used as an interposer, a PCB connector, or could be formed as a PCB. The scalability of the present invention is not limited, and can be easily customized for particular applications.

Referring to FIG. 14, a method 200 for making a connector is shown. The method includes providing a printed circuit board (PCB) having first and second surfaces (step 202). The method further includes deep drawing a first conductive material sheet to form a plurality of bodies (step 204), optionally removing the closed ends of the bodies (step 206), and forming an opening in at least a portion of a side wall of each of the bodies to create compliant pins (step 208). The first conductive material sheet is attached to the first surface of the PCB (step 210). A plurality of contact elements having at least one elastic portion are formed from a second conductive material sheet (212). The second conductive material sheet is attached to the second surface of the PCB (step 214). Preferably, the compliant pins and the contact elements are singulated (step 216). Optionally, some of the compliant pins and/or contact elements may remain non-singulated as required by the particular application. The method also includes connecting the contact elements to the compliant pins using vias (step 218).

One or more of the above-described steps may be omitted and/or performed in a different order. Further, while the preferred method is disclosed, the above-described embodiments are not limited by the preferred method. Any suitable method may be employed to construct the disclosed devices.

Although the present invention has been described in detail, it is to be understood that the invention is not limited thereto, and that various changes can be made therein without departing from the spirit and scope of the invention, which is defined by the attached claims.

What is claimed is:

1. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, having resilient elastic portions for making electrical contact with a device facing the second surface; and a plurality of electrical paths connecting the compliant pins to the contact elements.

2. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, each of the contact elements having at least two resilient elastic portions for making electrical contact with a device facing the second surface; and a plurality of electrical paths connecting the compliant pins to the contact elements.

3. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements formed of material deposited on the substrate, having resilient elastic portions for making electrical contact with a device facing the second surface; and a plurality of electrical paths connecting the compliant pins to the contact elements.

4. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, at least some of the contact elements having resilient elastic portions for making electrical contact with a device facing the second surface, and at least one of the contact elements including a resilient elastic portion for making electrical contact with a device facing the first surface; and a plurality of electrical paths connecting the compliant pins to the contact elements.

5. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements attached to the second surface of the substrate, having resilient elastic portions for making electrical contact with a device facing the second surface; and a plurality of electrical paths connecting the compliant pins to the contact elements.

6. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, having resilient elastic portions for making electrical contact with a device facing the second surface, and at least one of the contact elements being singulated from adjacent ones of the contact elements; and a plurality of electrical paths connecting the compliant pins to the contact elements.

7. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate, and at least one of the compliant pins being singulated from adjacent ones of the compliant pins;

a plurality of contact elements, connected to the substrate, having resilient elastic portions for making electrical contact with a device facing the second surface; and a plurality of electrical paths connecting the compliant pins to the contact elements.

8. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, having resilient elastic portions extending outwardly from the second surface away from the substrate for making electrical contact with a device facing the second surface; and a plurality of electrical paths connecting the compliant pins to the contact elements.

9. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, having resilient elastic portions including at least two opposing arms for receiving a BBGA facing the second surface; and a plurality of electrical paths connecting the compliant pins to the contact elements.

10. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, having resilient elastic portions including at least two opposing arms for receiving a BLGA facing the second surface; and a plurality of electrical paths connecting the compliant pins to the contact elements.

11. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate and an opening on the at least one sidewall substantially parallel to the given axis;

a plurality of contact elements, connected to the substrate, having resilient elastic portions for making electrical contact with a device facing the second surface; and a plurality of electrical paths connecting the compliant pins to the contact elements.

12. An electrical interposer comprising:

a substrate having first and second surfaces;

a plurality of compliant pins formed in an array on a conductive metal sheet attached to the first surface of the substrate, each of the compliant pins having a drawn body with at least one side wall extending along a given axis substantially perpendicular to the substrate;

a plurality of contact elements, connected to the substrate, having resilient elastic portions for making electrical contact with a device facing the second surface; and a plurality of electrical paths connecting the compliant pins to the contact elements.

13. An electrical interposer comprising:

a substrate having first and second surfaces;

a plurality of compliant pins connected to the first surface of the substrate, each of the compliant pins having a drawn body, including a taper, with at least one side wall extending along a given axis substantially perpendicular to the substrate;

a plurality of contact elements, connected to the substrate, having resilient elastic portions for making electrical contact with a device facing the second surface; and a plurality of electrical paths connecting the compliant pins to the contact elements.

14. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, having resilient elastic portions for making electrical contact with a device facing the second surface; and a plurality of electrical paths, including conductive material located in vias within the substrate, connecting the compliant pins to the contact elements.

15. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, having resilient elastic portions for making electrical contact with a device facing the second surface; and a plurality of through plated vias within the substrate connecting the compliant pins to the contact elements.

16. An electrical interposer comprising:

a substrate having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, having resilient elastic portions for making electrical contact with a device facing the second surface; and a plurality of electrical paths, including conductive traces formed in through holes and on at least one of the first and second surfaces of the substrate, connecting the compliant pins to the contact elements.

17. An electrical interposer comprising:

a substrate, including a PCB, having first and second surfaces;

a plurality of compliant pins connected to the first surface of the substrate, each of the compliant pins having a drawn body with at least one side wall extending along a given axis substantially perpendicular to the substrate;

a plurality of contact elements, connected to the substrate, having resilient elastic portions for making electrical contact with a device facing the second surface; and a plurality of electrical paths connecting the compliant pins to the contact elements.

18. An electronic component assembly, comprising:

a connector including a substrate, a plurality of drawn compliant pins connected to a first surface of the substrate, each of the compliant pins having a drawn body with at least one side wall extending substantially perpendicular to the substrate, an array of contact elements, having resilient elastic portions, connected to a second surface of the substrate, and electric paths through the substrate electrically connecting at least some of the contact elements to at least some of the compliant pins;

a first device, including at least one opening having a conductive inner surface portion which receives at least one of the compliant pins, the at least one of the compliant pins making contact with at least a portion of the conductive inner surface portion of the at least one opening; and a second device, including a plurality of contacts which contact at least one of the contact elements of the connector.

19. An electronic component assembly, comprising:

a connector including a substrate, a plurality of drawn compliant pins connected to a first surface of the substrate, each of the compliant pins having a drawn body with at least one side wall extending substantially perpendicular to the substrate, an array of contact elements, having resilient elastic portions, connected to a second surface of the substrate, and electric paths through the substrate electrically connecting at least some of the contact elements to at least some of the compliant pins;

a first device, including at least one opening having a conductive inner surface portion which receives at least one of the compliant pins, the at least one of the compliant pins maintaining an interference fit with at least a portion of the conductive inner surface portion of the at least one opening; and a second device, including a plurality of contacts which contact at least one of the contact elements of the connector.

20. An electronic component assembly, comprising:

a connector including a substrate, a plurality of drawn compliant pins connected to a first surface of the substrate, each of the compliant pins having a drawn body with at least one side wall extending substantially perpendicular to the substrate, an array of contact elements, having resilient elastic portions, connected to a second surface of the substrate, and electric paths through the substrate electrically connecting at least some of the contact elements to at least some of the compliant pins;

a first device, including at least one opening having a conductive inner surface portion which receives at least one of the compliant pins, the at least one of the compliant pins making contact with at least a portion of the conductive inner surface portion of the at least one opening and attached to the at least one opening by an adhesive; and a second device, including a plurality of contacts which contact at least one of the contact elements of the connector.

21. An electronic component assembly, comprising:

a connector including a substrate, a plurality of drawn compliant pins connected to a first surface of the substrate, at least one of the compliant pins including a side wall extending along a length of the pin substantially perpendicular to the substrate, an array of contact elements, having resilient elastic portions, connected to a second surface of the substrate, and electric paths through the substrate electrically connecting at least some of the contact elements to at least some of the compliant pins;

a first device, including at least one opening having a conductive inner surface portion which receives at least one of the compliant pins, the at least one of the compliant pins making contact with at least a portion of the conductive inner surface portion of the at least one opening; and a second device, including a plurality of contacts which contact at least one of the contact elements of the connector.

22. The electrical interposer of claim 1, the drawn body having an open end opposite to the first surface.

23. The electrical interposer of claim 1, the drawn body being cylindrical, having a hollow cylindrical interior, and defining an opening opposite to the first surface.

24. The electrical interposer of claim 1, a cross-section of the drawn body being rectilinear in shape, the cross-section taken parallel to the first surface.

25. The electronic component assembly of claim 21, the at least one of the compliant pins having an open end opposite to the first surface, and the side wall of the at least one of the compliant pins making contact with the at least a portion of the conductive inner surface portion of the at least one opening.

26. The electronic component assembly of claim 21, the at least one of the compliant pins having an outer cylindrical surface, having a hollow cylindrical interior, and defining an opening opposite to the first surface, the outer cylindrical surface making contact with the at least a portion of the conductive inner surface portion of the at least one opening.

27. The electronic component assembly of claim 21, a cross-section of the at least one of the compliant pins being rectilinear in shape, the cross-section taken parallel to the first surface.

* * * * *

UNITED STATES PATENT AND TRADEMARK OFFICE

CERTIFICATE OF CORRECTION

PATENT NO. : 7,090,503 B2
APPLICATION NO. : 10/894608
DATED : August 15, 2006
INVENTOR(S) : Dittmann It is certified that error appears in the above-identified patent and that said Letters Patent is hereby corrected as shown below:

TITLE PAGE,
Page 2, ITEM (56), under "U.S. Patent Documents, in column 1, line 51, after "Gosselin" delete "438/78" and insert -- 439/78 --, therefor.

In column 2, line 54, delete "(i.e." and insert -- (i.e., --, therefor.

Signed and Sealed this

Nineteenth Day of June, 2007

JON W. DUDAS
*Director of the United States Patent and Trademark Office*